US012595092B2

(12) United States Patent
Klavdianos

(10) Patent No.: US 12,595,092 B2
(45) Date of Patent: Apr. 7, 2026

(54) STATIONERY PAPER PACKAGING

(71) Applicant: BIC Violex Single Member S.A., Anoixi (GR)

(72) Inventor: Dionysios Klavdianos, Anoixi (GR)

(73) Assignee: BIC Violex Single Member S.A., Anoixi (GR)

( * ) Notice: Subject to any disclaimer, the term of this patent is extended or adjusted under 35 U.S.C. 154(b) by 0 days.

(21) Appl. No.: 18/834,514

(22) PCT Filed: Feb. 3, 2023

(86) PCT No.: PCT/EP2023/052642
§ 371 (c)(1),
(2) Date: Jul. 30, 2024

(87) PCT Pub. No.: WO2023/152034
PCT Pub. Date: Aug. 17, 2023

(65) Prior Publication Data

US 2025/0178776 A1 Jun. 5, 2025

(30) Foreign Application Priority Data

Feb. 11, 2022 (EP) ..... 22156305

(51) Int. Cl.
*B65D 5/52* (2006.01)
*A45C 11/34* (2006.01)
(Continued)

(52) U.S. Cl.
CPC ..... *B65D 5/5213* (2013.01); *A45C 11/34* (2013.01); *B65D 5/38* (2013.01); *B65D 5/4208* (2013.01); *A45C 2200/15* (2013.01)

(58) Field of Classification Search
CPC ..... A45C 11/36; A45C 11/34; A45C 2200/15; B65D 5/5273; B65D 5/5206; B65D 5/5213; B65D 5/38; B65D 5/4208
(Continued)

(56) References Cited

U.S. PATENT DOCUMENTS 1,591,412 A * 7/1926 Biesel ..... B65D 5/5206 211/70.1
1,631,595 A 6/1927 Kappes
(Continued)

FOREIGN PATENT DOCUMENTS

CN 204250540 U 4/2015
EP 0330969 A1 9/1989
EP 3448197 B1 11/2020

OTHER PUBLICATIONS

Search Report and Written Opinion issued in International Application PCT/EP2023/052642, mailed Aug. 17, 2023.

*Primary Examiner* — Steven A. Reynolds
(74) *Attorney, Agent, or Firm* — Bookoff McAndrews, PLLC

(57) ABSTRACT

A paper packaging for storing and presenting a plurality of longitudinal hand held implements, said packaging including: a sleeve, a tray, an insert, wherein the tray is configured to accommodate the insert, and the sleeve is configured to accommodate the tray, wherein the insert includes a stand mechanism, including a handle that protrudes from the insert and that is configured to protrude from the tray, and configured so that pulling the handle folds and raises the stand mechanism so as to lift implements arranged in the insert.

12 Claims, 6 Drawing Sheets

(51) Int. Cl.
*B65D 5/38* (2006.01)
*B65D 5/42* (2006.01)

(58) Field of Classification Search
USPC ..... 206/214, 758, 762, 45.27, 45.25, 45.24
See application file for complete search history.

(56) References Cited

U.S. PATENT DOCUMENTS

| | | | | | |
|---|---|---|---|---|---|
| 1,726,732 | A | * | 9/1929 | Doran | B65D 5/504 206/755 |
| 1,987,804 | A | | 1/1935 | Wilson | |
| 2,036,822 | A | | 4/1936 | Myers | |
| 2,277,097 | A | | 3/1942 | Hansen | |
| 2,813,621 | A | * | 11/1957 | Parker, II | B65D 5/5213 206/760 |
| 4,573,569 | A | * | 3/1986 | Parker | B44D 3/123 206/483 |
| 4,784,315 | A | | 11/1988 | Dutcher | |
| 4,896,766 | A | * | 1/1990 | Paley | B65D 5/5213 206/754 |
| 5,096,055 | A | * | 3/1992 | Opper | B65D 5/5213 206/754 |
| 5,165,534 | A | | 11/1992 | Kaufman et al. | |
| 5,341,923 | A | * | 8/1994 | Arasim | B65D 5/4208 206/214 |
| 2017/0245611 | A1 | * | 8/2017 | Brown, Jr. | A45C 11/34 |

* cited by examiner

STATIONERY PAPER PACKAGING

CROSS-REFERENCE TO RELATED APPLICATIONS

This is a National Stage Application under 35 U.S.C. § 371 of International Application No. PCT/EP2023/052642, filed Feb. 3, 2023, now published as WO 2023/152034 A1, which claims priority to European Patent Application No. 22156305.9, filed on Feb. 11, 2022, the entireties of which are incorporated herein by reference.

TECHNICAL FIELD

The present disclosure relates to the field of stationery packaging, and more specifically to a sustainable paper packaging that facilitate easy product overview and selection.

BACKGROUND

Stationery packaging for drawing and colouring products usually feature numerous colour hues which are arrayed in rows one next to the other in order to provide an unobstructed overview of the spectrum to the user.

However, low-cost solutions packaging tend to be structured in the form of a re-closable envelope or wallet. Due to the structure of the envelope, the contents visibility is usually obstructed or restricted to the marginal maximum so as not to compromise the rigidity of the envelope. In addition, in order to restrict the contents from wobbling inside the pack, the space between the contents is minimized, thus resulting in a tight fit where the friction between the contents results in bad ergonomics and difficulties for the user to grab and pull out the colour of reference.

By contrast, if we consider high end packaging solution, such packaging solutions often incorporate more rigid materials, such as wood, metals, plastics, paper pulp or paper foam in order to define pockets with adequate spacing in between them which, facilitate selection and picking of the contents and therefore improved ergonomics.

However, the utilization of such might present complexity, cost implications and affect the sustainability characteristics and attributes of the offer.

Furthermore, after the product purchase, the user interaction with the packaging is limited to the use of the contents. The packaging becomes more of a storage object, in the case where its structure is rigid enough to withstand multiple use and wear off when carried for instance in a backpack.

Otherwise, the packaging can be rejected, and its contents are transferred to a container such as a textile pouch, a metallic case, etc., thereby minimizing or terminating the actual packaging lifecycle which affects the overall sustainability.

In addition, packaging elements that are deprived of fun or playful elements tend to not incite the user to ensure the functional integrity of such packaging elements, which therefore reduces the functionality and the willingness to keep it.

The present disclosure aims to at least partially address one or more problems in the prior art.

SUMMARY

In a first aspect, the present disclosure relates to a paper packaging for storing and presenting a plurality of longitudinal hand held implements, said packaging comprising:

a sleeve, a tray, an insert, wherein the tray is configured to accommodate the insert, and the sleeve is configured to accommodate the tray, characterized in that the insert comprises a stand mechanism, comprising a handle that protrudes from the insert and that is configured to protrude from the tray, and configured so that pulling the handle folds and raises the stand mechanism so as to lift implements arranged in the insert.

In some embodiments, the insert comprises a plurality of housings adapted to receive and maintain implements, the housings of the insert are arranged at a first end of the insert, and are configured to accommodate a proximal end of longitudinal hand held implements, and the stand mechanism is provided on a second end of the insert opposite to the first end.

In some embodiments, the tray has a rectangular shape, comprising a rectangular bottom panel with peripheral walls extending on one side of said bottom panel, and wherein one of said peripheral walls comprises a slot through which the handle of the insert protrudes when the insert is positioned in the tray.

In some embodiments, the insert comprises a base panel adapted to be arranged on the bottom panel of the tray, said base panel comprising a first end and a second end opposite to the first end, a first stand panel that extends from the second end of the insert, a second stand panel that extends from the first stand panel and a handle that extends from the second stand panel, such that the handles arranged between the base panel of the insert on one side, and the first stand panel and the second stand panel on the other side, and protrudes from the second end of the base panel through a slot formed at the junction between the base panel and the first stand panel.

In some embodiments, the first stand panel and the second stand panel are configured such that the junction between the first stand panel and the second stand panel defines a fold line, wherein said fold line is provided with a plurality of slots adapted to accommodate implements.

In some embodiments, the insert is configured so that when the stand mechanism is in a folded configuration, the first stand panel and the second stand panel are parallel to the base panel of the insert, and wherein when the stand mechanism is in a raised configuration, the first stand panel, the second stand panel and the base panel define a volume with a triangular section In some embodiments, said slots are defined by openings formed in the first stand panel and in the second stand panel.

In some embodiments, said slots are arranged in line with the housings such that a pair comprising a slot and a housing is adapted to maintain a longitudinal implement when the stand mechanism is in a raised configuration.

In some embodiments, the sleeve comprises a tab formed on a front side or a rear side of the sleeve, said tab being configured to engage a lateral side of the sleeve to maintain it in a closed configuration.

In some embodiments, the sleeve is adapted to accommodate two or more trays and two or more inserts each positioned within one of said two or more trays.

In some embodiments, the sleeve, the tray and the insert are made of carton.

In some embodiments, the insert is made out of a single die-cut structure.

In some embodiments, the sleeve and the tray are each made out of a single die-cut structure.

The present disclosure also presents a kit comprising a paper packaging as defined previously and a plurality of longitudinal hand held implements within said paper packaging.

In some embodiments, said longitudinal hand held implements are markers, coloured pencils, felt-pens or ballpoint pens.

DETAILED DESCRIPTION

Hereinafter, a detailed description will be given of the present disclosure with reference to FIGS. 1 to 7. The terms or words used in the description and the aspects of the present disclosure are not to be construed limiting as only having common-language or dictionary meanings and should, unless specifically defined otherwise in the following description, be interpreted as having their ordinary technical meaning as established in the relevant technical field. The detailed description will refer to specific embodiments to better illustrate the present disclosure, however, it should be understood that the presented disclosure is not limited to these specific embodiments.

Figure 1:
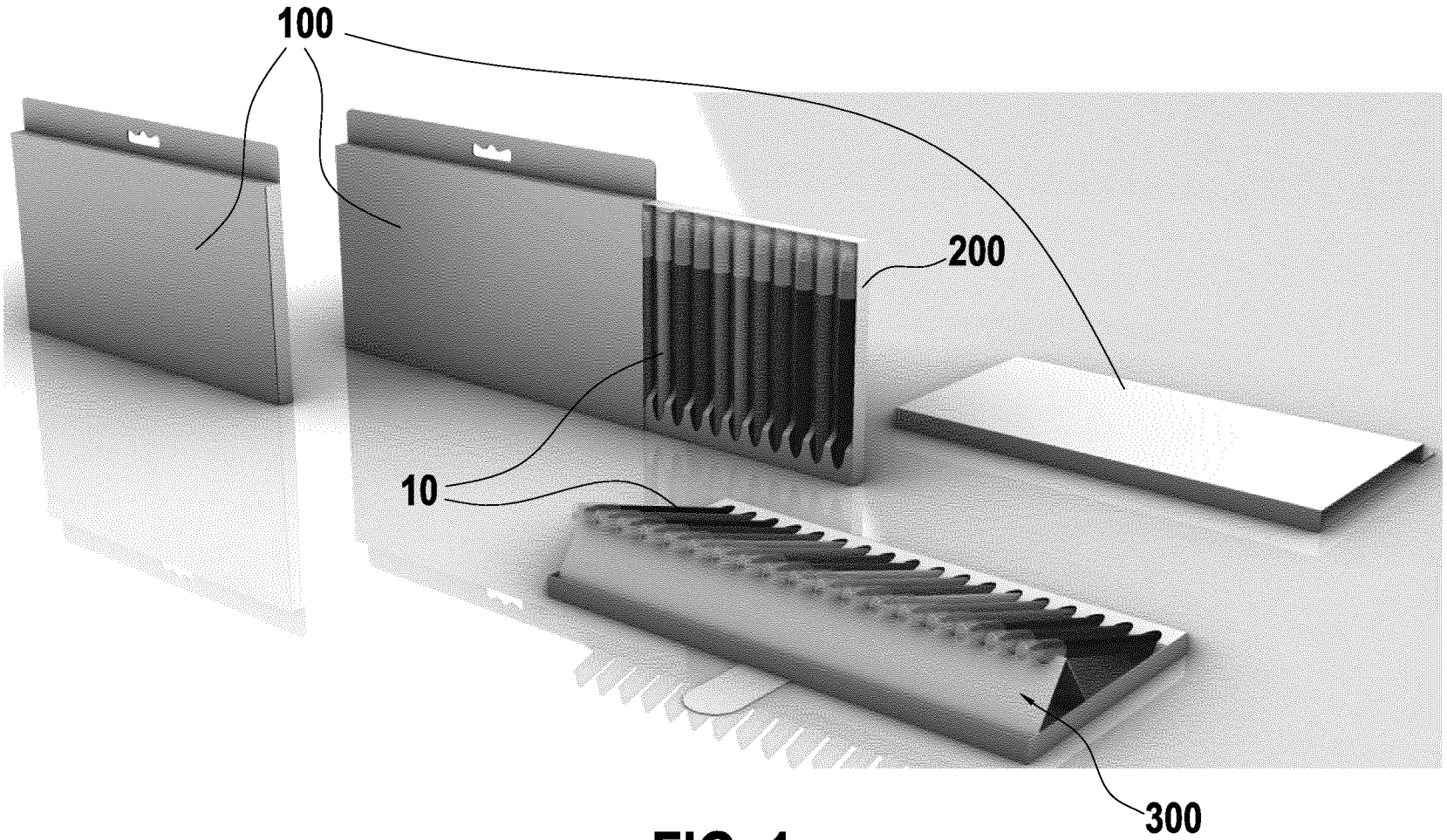
FIG. 1 shows a first exemplary embodiment of a packaging of the present disclosure.
Figure 2:
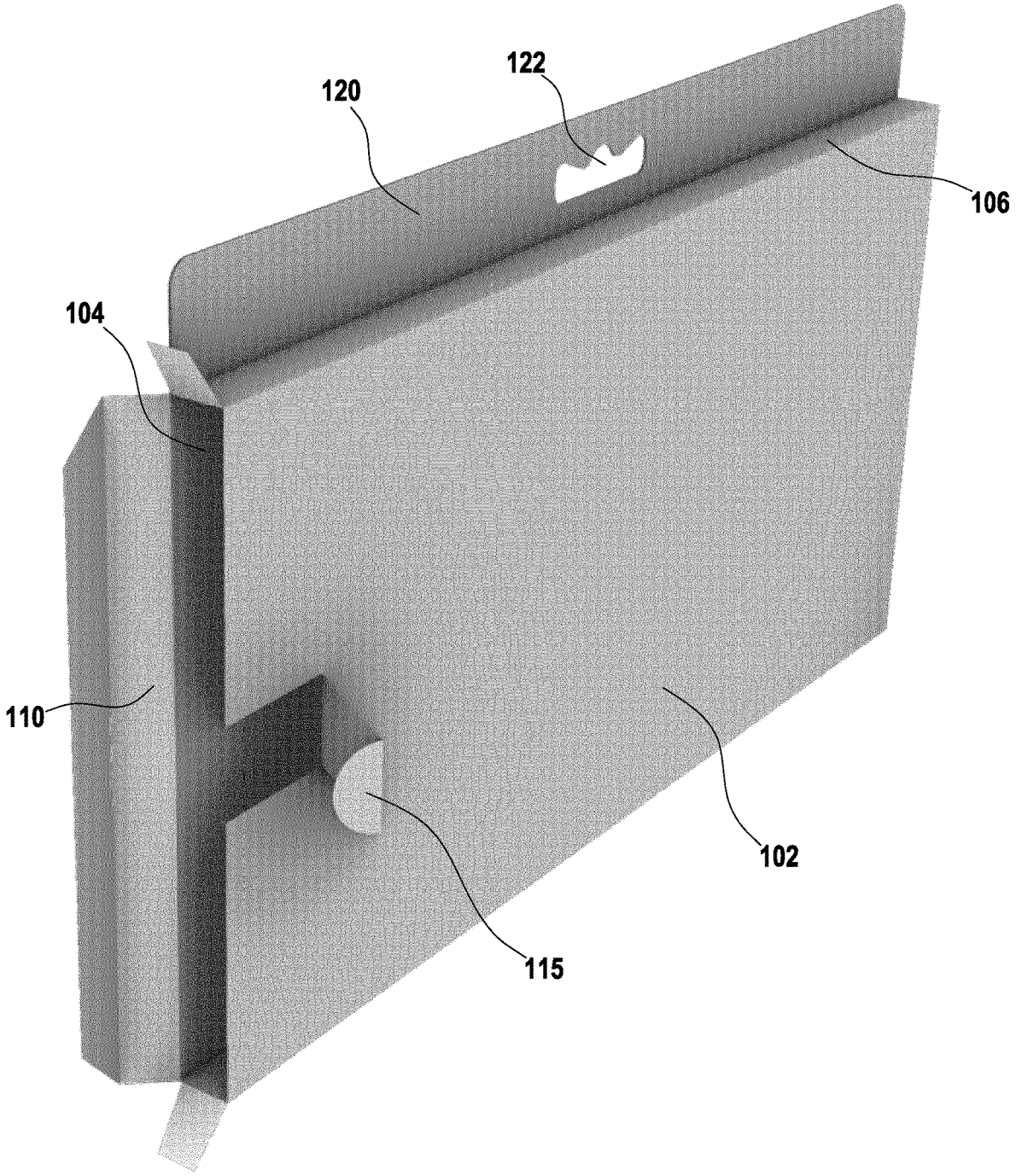
FIG. 2 shows an exemplary embodiment of a component of this packaging.
Figure 3:
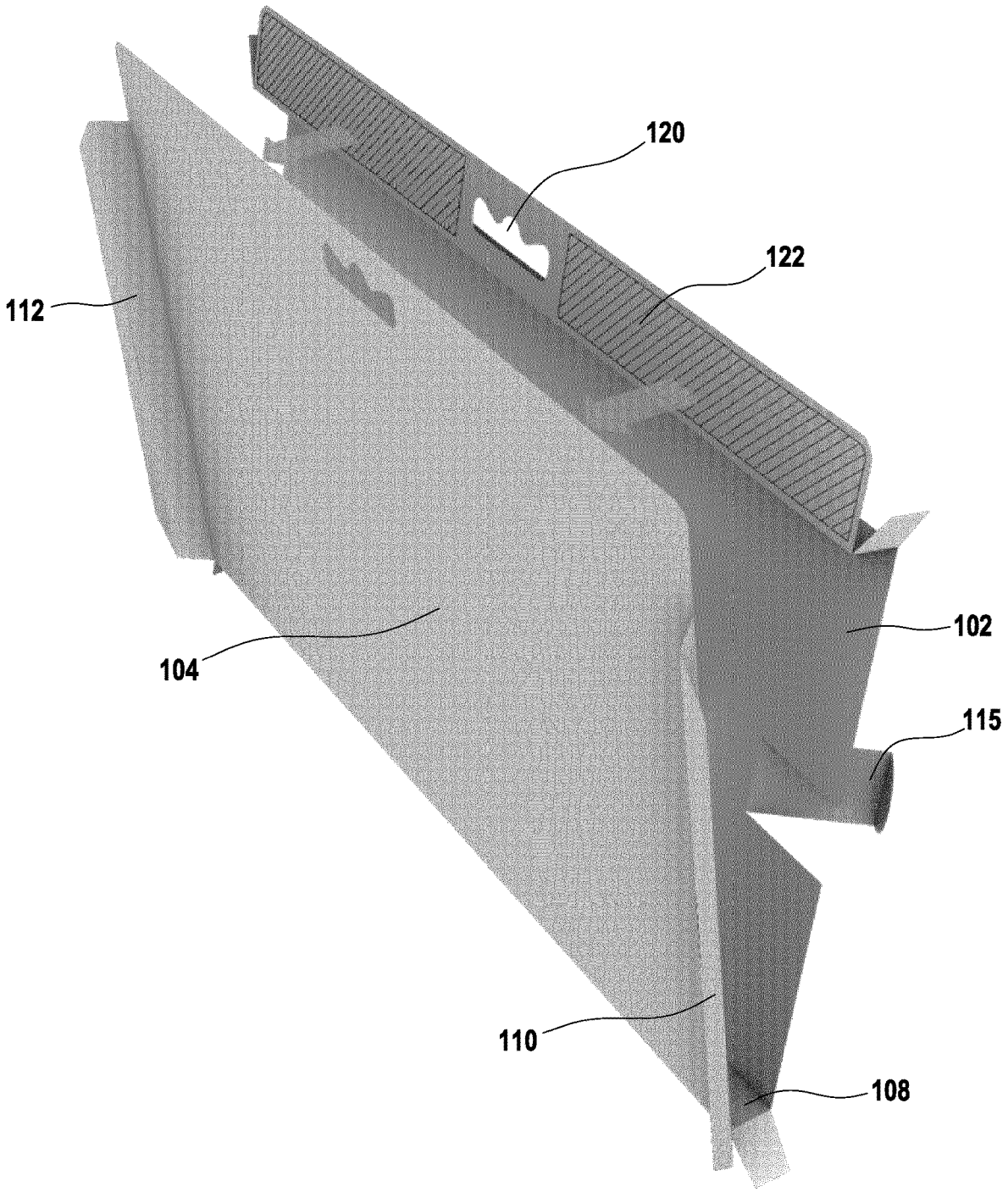
FIG. 3 shows another view of the component presented in FIG. 2.

An overall view of products made according to the present disclosure is presented in FIG. 1. FIGS. 2 to 7 then present various detailed view of some elements of this product.

The product presented in the present disclosure is a paper packaging for storing and presenting a plurality of longitudinal hand held implements such as pens, pencils, markers, felt-tip pens, coloured pencils or crayons.

The paper packaging may be made of carton.

The paper packaging as presented comprises a sleeve 100, a tray 200 and an insert 300.

The sleeve 100 defines an outer envelope of the product, and accommodates the tray 200, the insert 300 and a plurality of longitudinal hand held implements such as pens, pencils, markers, felt-tip pens, coloured pencils or crayons.

The sleeve 100 may be made out of a single die-cut structure.

In the illustrated example, the sleeve 100 is made out of a piece of carton which is folded so as to define a front side 102, a rear side 104, a top side 106, a bottom side 108 and two lateral sides 110 and 112 that can be opened to insert or extract the tray 200 and the insert 300 from the sleeve 100.

The top side 106 may be prolonged by a display tab 120 provided with a through opening 122 for putting the packaging on display. The display tab 120 may be formed by assembling a portion that extends from the top side 106 and a portion that extends from the rear side 104, for instance by gluing said portions together so as to close the packaging. In the illustrated embodiments, the sleeve 100 presents a generally rectangular section.

The front side 102 and/or the rear side 104 may be provided with a tab 115 configured to engage at least one of the lateral sides 110 and/or 112, for instance to maintain the sleeve 100 in a closed configuration. By pulling the tab 115, the user can then open one of the lateral sides 110 or 112 so as to access to the contents of the sleeve 100.

The tray 200 and the insert 300 may be inserted within the sleeve 100. The insert 300 may be configured to be positioned within the tray 200.

The tray 200 may present a shape to fit within the sleeve 100, for instance a comprising a rectangular bottom panel 202 with peripheral walls 204, 206, 208 and 210 extending on one side of said bottom panel 202, from the edges of said bottom panel 202.

The tray 200 may be made out of a single die-cut structure.

The insert 300 may be configured to be positioned within the tray 200.

The insert 300 as illustrated presents a base panel 302 adapted to be arranged on the bottom panel 202 of the tray 200. The insert 300 may be made out of a single die-cut structure.

For ease of description, we define for the base panel 302 a first end 304 and a second end 306 opposed to the first end.

In the drawings, these two ends 304 and 306 correspond to the length sides of the base panel 302, although one can appreciate that this is not limiting, and that the dimensions of the base panel 302 depend on the implements to be stored.

A plurality of housings 310 are formed on the first end 304 of the base panel 302.

The plurality of housings 310 may be formed by folding one or more panels that extend from the first end 304 of the base panel 302.

The housings 310 may for instance be formed by folding three or more panels that extend from the first end 304 of the base panel 302, wherein at least one of these panels may be provided with cuts so as to define slots or openings each adapted to receive an end of a longitudinal hand held implement so as to store and maintain such implements side by side.

At least one of the panels that define the housings 310 may be fixed, for instance with glue or with an adhesive, to the base panel 302.

The second end 306 of the base panel 302 is provided with a stand mechanism 320.

The stand mechanism 320 comprise a first stand panel 322 that extends from the second 306 of the base panel 302, and a second stand panel 324 that extends from the first stand panel 322 so that the first stand panel 322 is connected from two opposite edges to the base panel 306 and to the second stand panel 324.

The second stand panel 324 is provided with a handle 330 that extends from an edge of the second stand panel 324 opposite to the edge of the second stand panel 324 that is connected to the first stand panel 322.

The handle 330 may be arranged in a central portion of an edge of the second stand panel 324.

The handle 330 may be arranged between the base panel 302 of the insert 300 on one side, and the first stand panel 322 and the second stand panel 324 on the other side.

The junction between the second end 306 of the base panel 302 and the first stand panel 322 may be provided with a slot so that the handle 330 can pass through said slot and protrude from the insert 300.

The tray 200 may also be provided with a slot formed at the junction between the bottom panel 202 and one of the peripheral walls, the peripheral wall 210 in the illustrated example.

This slot in the tray 200 is typically arranged to be in line with the slot in the insert 300, so that when the insert 300 is positioned in the tray 200, the handle 330 may protrude from the tray 200 through said slots, for instance so as to be protrude horizontally from the tray 200, the horizontal plane being here defined by the base panel 300 of the insert 300 and/or the bottom panel 202 of the tray 200.

The junction between the first stand panel 322 and the second stand panel 324 define a fold line, which may be provided with a plurality of slots 326 that may be formed to accommodate the implements.

The slots 326 are typically in line with the housings 310, so that an implement arranged within the insert may be held from one side by one of the housings 310, and also by one of the slots 326.

The packaging as disclosed can be used as follows.

The insert 300 is positioned within the tray 200.

A plurality of longitudinal hand held implements 10 may be arranged in the tray 200, these implements 10 being held in position by the housings 310 of the insert 300.

The tray 200 which holds the insert 300 and the implements 10 can be inserted in the sleeve 100.

When inserted in the sleeve 100, the handle 330 of the insert 300 is typically folded between the tray 200 and the sleeve 100, for instance between the bottom panel 202 of the tray 200 and the front side 102 or the rear side 104 of the sleeve 100.

The sleeve 100 can be configured to hold one or more of such trays 200, inserts 300 and implements 10.

On use, the user can open the sleeve 100 to extract the tray 200 which holds the insert 300 and the implements 10.

The user can then pull the handle 330 of the insert 300. By pulling the handle 330, this will act on the first stand panel 322 and the second stand panel 324 to define fold lines that act as hinges between the handle 330 and the second stand panel 324, between the first stand panel 322 and the second stand panel 324, and between the second stand panel 324 and the base panel 302.

The first stand panel 322 and the second stand panel 324 then rise up and protrude from the base panel 302 typically to form a stand with a triangular section, which lift the implements 10 while maintaining one end of the implements 10 in the housings 310. The implements 10 are therefore lifted from an original horizontal position to an inclined position through a sliding function which is activated by the handle 330.

Figure 4:
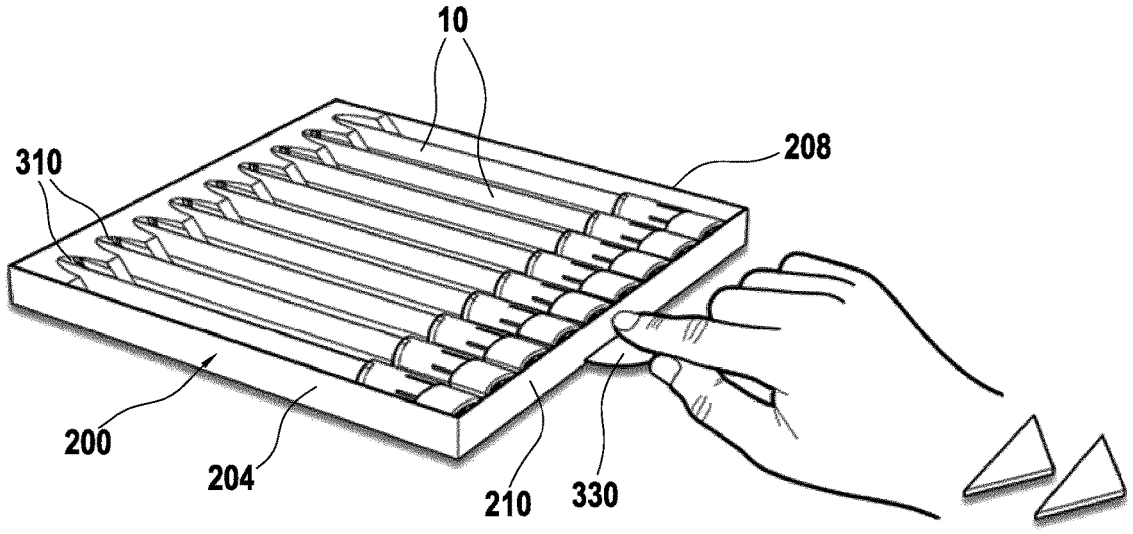
FIG. 4 shows an exemplary embodiment of a component of this packaging.
Figure 5:
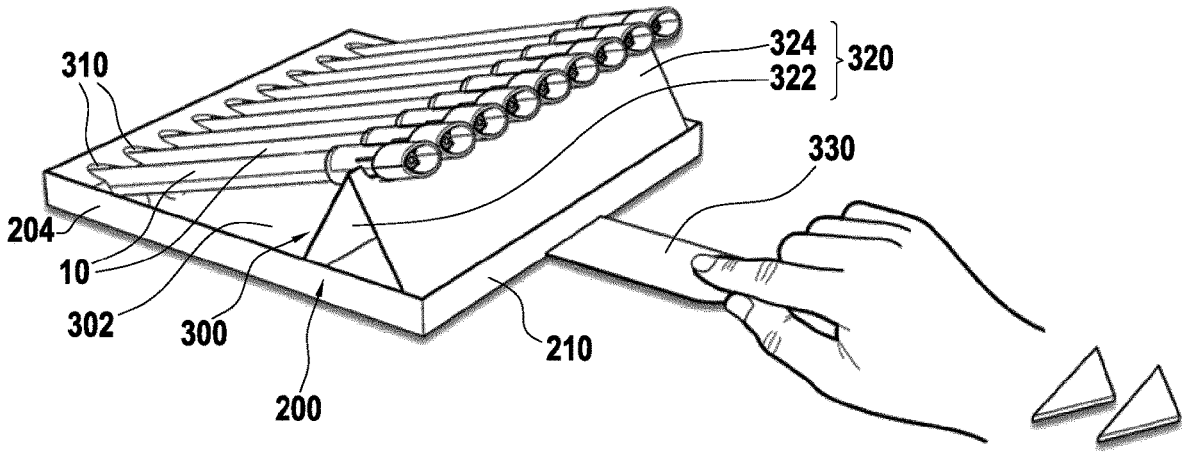
FIG. 5 shows another view of the component presented in FIG. 4.
Figure 6:
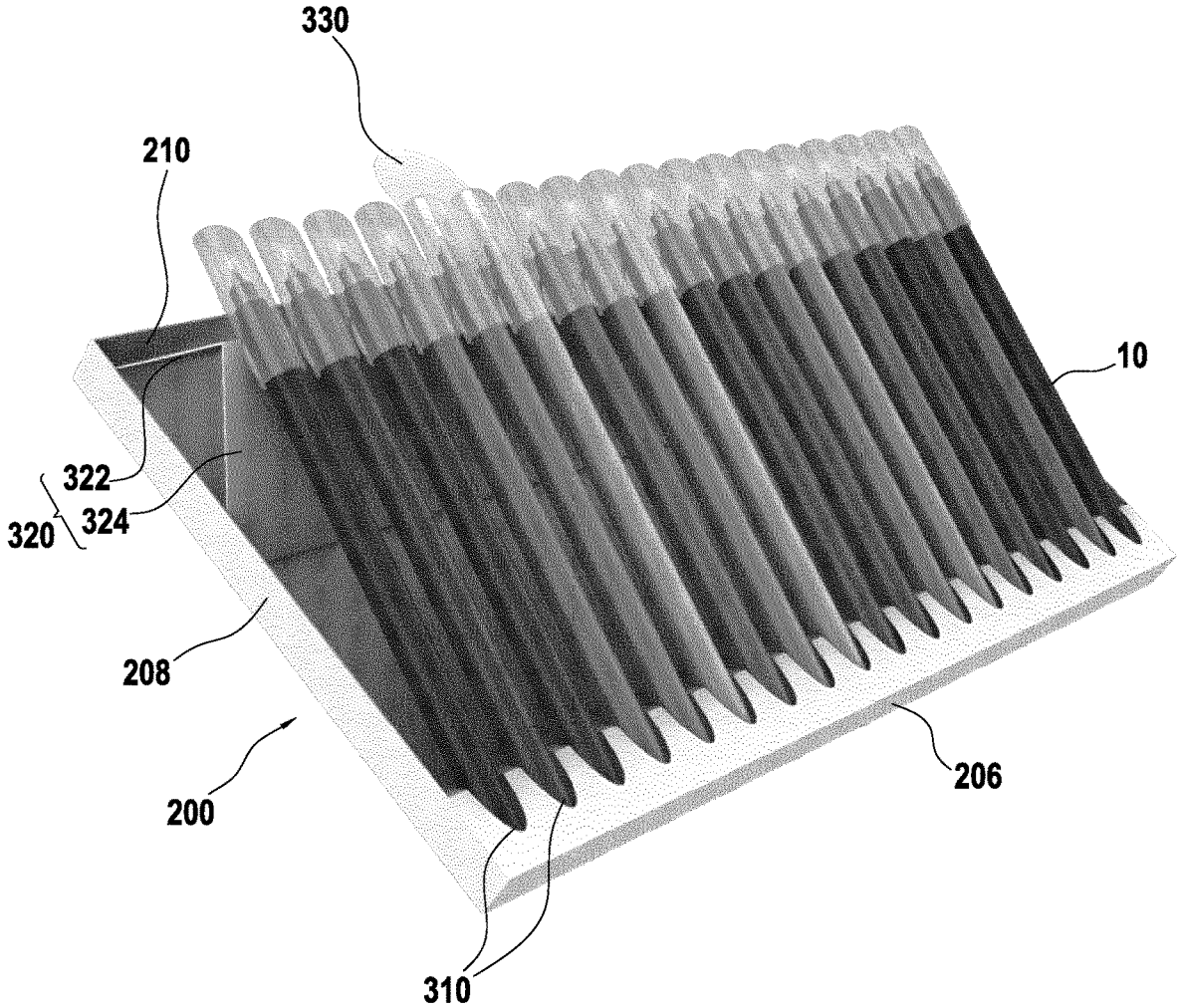
FIG. 6 shows another view of the component presented in FIG. 5.
Figure 7:
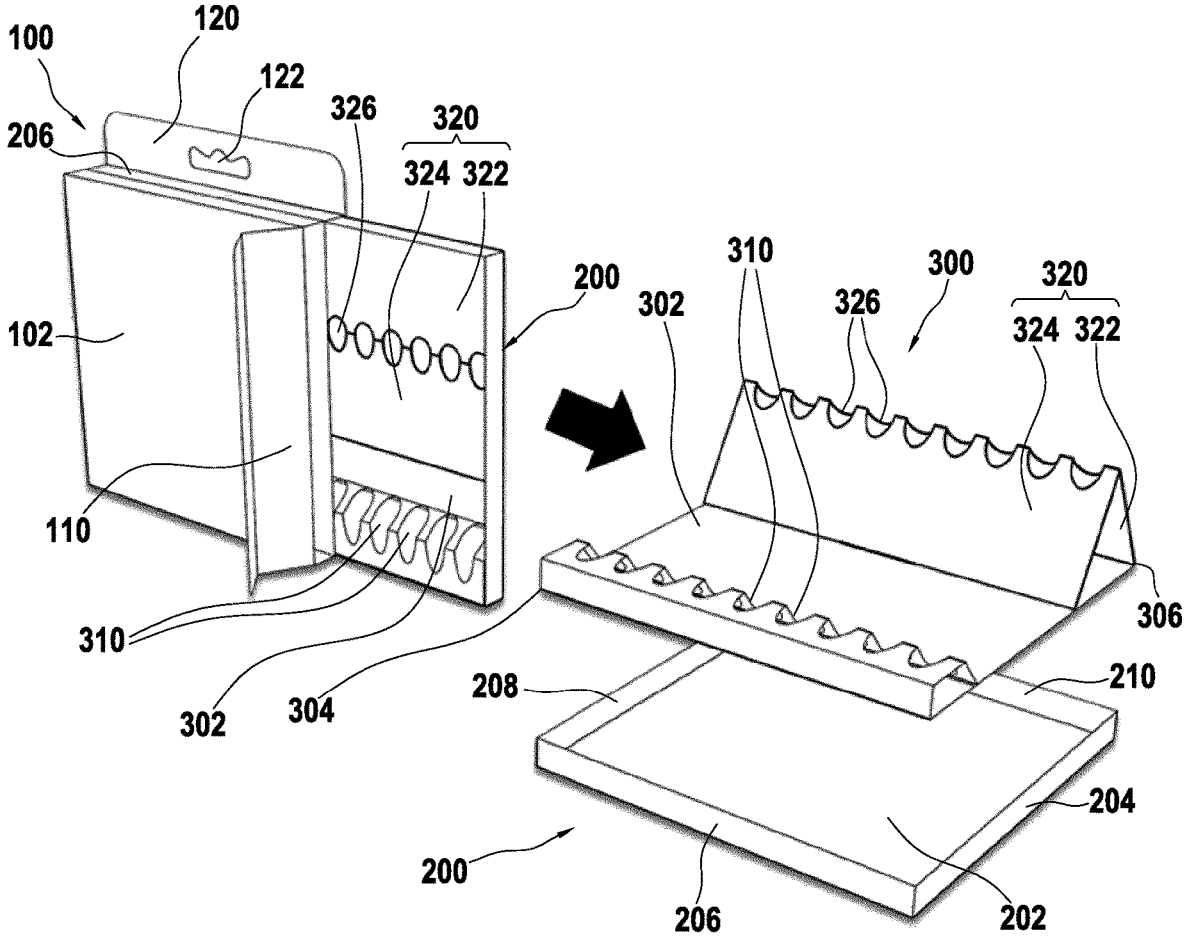
FIG. 7 shows another view of a packaging of the present disclosure.

This sliding function is illustrated in FIGS. 4 and 5; FIG. 4 represents an initial configuration in which the implements 10 are maintained in a horizontal configuration, while FIG. 5 illustrates a lifted configuration once the user has pulled the handle 330.

The friction between the handle 330 and the insert 300 and the tray 200 ensures that the stand mechanism 320 remains in a lifted position.

The user can then push the handle 330 back into its original retracted position to bring back the implements 10 to the horizontal configuration. The user may also push on the lifted implements 10 and/or on the lifted stand mechanism 320, for instance at the junction between the first stand panel 322 and the second stand panel 324, which will have the effect of lowering down the stand mechanism 320 until the implements 10 reach their initial horizontal position.

The paper packaging as disclosed therefore ensures a proper display of the implements 10, enabling a user to have a full view on the colours of the implements 10 on display, while the implements 10 are securely held in position by the insert 300.

The paper packaging as disclosed therefore provides an advantageous effect in relation to three distinct ergonomic parameters: visibility, grab and extraction.

The incorporation of the sliding function between the tray 200 and the insert 300 allows the user to get a total and unobstructed overview of the implements 10 available.

The disclosed packaging is advantageous in terms of sustainability and production as it can be made out of carton, without requiring the addition of additional materials such as wood, metal or plastics.

Although the embodiments of the present disclosure have been disclosed for illustrative purposes, those skilled in the art will appreciate that various modifications and alterations are possible, without departing from the spirit of the present disclosure. It is also to be understood that such modifications and alterations are incorporated in the scope of the present disclosure and the accompanying claims.

The invention claimed is:

1. A paper packaging for storing and presenting a plurality of longitudinal hand held implements, said packaging comprising:

a sleeve, a tray, an insert, wherein the tray is configured to accommodate the insert, and the sleeve is configured to accommodate the tray, wherein the insert comprises a stand mechanism, comprising a handle that protrudes from the insert and that is configured to protrude from the tray, and configured so that pulling the handle folds and raises the stand mechanism so as to lift implements arranged in the insert, wherein the insert comprises a plurality of housings adapted to receive and maintain implements, the housings of the insert are arranged at a first end of the insert, and are configured to accommodate a proximal end of the longitudinal hand held implements, and the stand mechanism is provided on a second end of the insert opposite to the first end, wherein the tray has a rectangular shape, comprising a rectangular bottom panel with peripheral walls extending on one side of said bottom panel, and wherein one of said peripheral walls comprises a slot through which the handle of the insert protrudes when the insert is positioned in the tray, wherein the insert comprises a base panel adapted to be arranged on the bottom panel of the tray, said base panel comprising a first end and a second end opposite to the first end, a first stand panel that extends from the second end of the insert, a second stand panel that extends from the first stand panel and the handle extends from the second stand panel, such that the handle is arranged between the base panel of the insert on one side, and the first stand panel and the second stand panel on another side, and protrudes from the second end of the base panel through a slot formed at a junction between the base panel and the first stand panel.

2. The paper packaging of claim 1, wherein the first stand panel and the second stand panel are configured such that the junction between the first stand panel and the second stand panel defines a fold line, wherein said fold line is provided with a plurality of slots adapted to accommodate implements.

3. The paper packaging of claim 2, wherein said slots are defined by openings formed in the first stand panel and in the second stand panel.

4. The paper packaging of claim 2, wherein said slots are arranged in line with the housings such that a pair comprising a slot and a housing is adapted to maintain a longitudinal implement when the stand mechanism is in a raised configuration.

5. The paper packaging of claim 2, wherein when the stand mechanism is in a folded configuration, the first stand panel and the second stand panel are parallel to the base panel of the insert, and wherein when the stand mechanism is in a raised configuration, the first stand panel, the second stand panel and the base panel define a volume with a triangular section.

6. The paper packaging of claim 1, wherein the sleeve comprises a tab formed on a front side or a rear side of the sleeve, said tab being configured to engage a lateral side of the sleeve to maintain it in a closed configuration.

7. The paper packaging of claim 1, wherein the sleeve is adapted to accommodate two or more trays and two or more inserts each positioned within one of said two or more trays.

8. The paper packaging of claim 1, wherein the sleeve, the tray and the insert are made of carton.

9. The paper packaging of claim 1, wherein the insert is made out of a single die-cut structure.

10. The paper packaging of claim 1, wherein the sleeve and the tray are each made out of a single die-cut structure.

11. A kit comprising a paper packaging of claim 1 and a plurality of longitudinal hand held implements within said paper packaging.

12. The kit according to claim 11 wherein said longitudinal hand held implements are markers, coloured pencils, felt-pens or ballpoint pens.

* * * * *